US011073003B2

(12) United States Patent
Muraikhi

(10) Patent No.: US 11,073,003 B2
(45) Date of Patent: Jul. 27, 2021

(54) SMART COMPLETION WITH DRILLING CAPABILITIES

(71) Applicant: Saudi Arabian Oil Company, Dhahran (SA)

(72) Inventor: Abdullah I. Muraikhi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 109 days.

(21) Appl. No.: 16/594,724

(22) Filed: Oct. 7, 2019

(65) Prior Publication Data

US 2021/0102445 A1 Apr. 8, 2021

(51) Int. Cl.

| | |
|---|---|
| ***E21B 43/10*** | (2006.01) |
| ***E21B 7/04*** | (2006.01) |
| ***E21B 7/06*** | (2006.01) |
| ***E21B 7/20*** | (2006.01) |
| ***E21B 33/14*** | (2006.01) |

(52) U.S. Cl.

CPC ..... *E21B 43/10* (2013.01); *E21B 7/046* (2013.01); *E21B 7/061* (2013.01); *E21B 7/20* (2013.01); *E21B 33/14* (2013.01)

(58) Field of Classification Search

CPC . E21B 7/061; E21B 7/20; E21B 7/201; E21B 17/08; E21B 33/13; E21B 33/14

See application file for complete search history.

(56) References Cited

U.S. PATENT DOCUMENTS

| | | | |
|---|---|---|---|
| 6,189,621 | B1 | 2/2001 | Vail, III |
| 6,722,451 | B2 | 4/2004 | Saugier |
| 7,083,005 | B2 | 7/2006 | Galloway et al. |
| 7,108,083 | B2 * | 9/2006 | Simonds ..... E21B 7/20 166/227 |
| 7,108,084 | B2 | 9/2006 | Vail, III |
| 7,413,020 | B2 | 8/2008 | Carter et al. |
| 8,215,409 | B2 * | 7/2012 | Adam ..... E21B 43/105 166/384 |
| 9,022,113 | B2 | 5/2015 | Rex et al. |

(Continued)

FOREIGN PATENT DOCUMENTS

| | | |
|---|---|---|
| WO | 2016057032 A1 | 4/2016 |
| WO | 2018009437 A1 | 1/2018 |

OTHER PUBLICATIONS

International Search Report and Written Opinion of PCT Application No. PCT/US2020/054483 dated Jan. 25, 2021: pp. 1-11.

*Primary Examiner* — Tara Schimpf
(74) *Attorney, Agent, or Firm* — Bracewell LLP; Constance G. Rhebergen; Linda L. Morgan

(57) ABSTRACT

A method for completing a subterranean well with a smart completion system includes drilling the subterranean well to a first depth with a first drill string having a first drill string tubular and a first bottom hole assembly with a first drill bit. The first drill string is retrieved and a casing is cemented within the first depth. The subterranean well is drilled to a second depth with a second drill string having a second drill string tubular, a liner, and a second bottom hole assembly that includes a smart completion and a second drill bit. The liner is set within the casing and the second drill string tubular is retrieved, retaining the liner and the second bottom hole assembly within the subterranean well. Fluid from the subterranean well is produced through the second bottom hole assembly.

10 Claims, 4 Drawing Sheets

(56) References Cited

U.S. PATENT DOCUMENTS

| | | | | |
|---|---|---|---|---|
| 9,637,977 | B2 | 5/2017 | Giroux et al. | |
| 2004/0011534 | A1 | 1/2004 | Simonds et al. | |
| 2004/0256157 | A1* | 12/2004 | Tessari | E21B 43/10 175/57 |
| 2011/0315371 | A1* | 12/2011 | Khodayar | E21B 7/061 166/117.6 |
| 2012/0186816 | A1 | 7/2012 | Dirksen et al. | |
| 2017/0306719 | A1* | 10/2017 | Jerez | E21B 17/105 |
| 2019/0153810 | A1* | 5/2019 | Cervo | E21B 23/06 |
| 2019/0301266 | A1* | 10/2019 | Solbakk | E21B 33/14 |

* cited by examiner

SMART COMPLETION WITH DRILLING CAPABILITIES

BACKGROUND

1. Field of the Disclosure

The present disclosure relates in general to intelligent completions of subterranean wells, and more particularly to intelligent completions that are part of a drilling string.

2. Description of the Related Art

A liner can be used when completing some subterranean wells. The liner can include a completion assembly that is used during the operating life of the well. The liner is a tubular member use for producing from the well or delivering fluids into the well that does not extend to the surface. The liner instead is suspended from a casing and cemented in place.

The completion assembly can include, for example, a screen, a circulation valve for controlling the flow of fluids between a bore of the completion assembly and the annular space outside of the completion assembly within the wellbore, a packer that can form an annular seal around the annular space, and an internal valve that can seal the bore of the completion assembly.

When drilling and completing a subterranean well with a liner, some current methods include drilling to the final target depth of the well with a drill string then pulling the entire drill string before delivering the liner into the wellbore. The final drilling operation and completion of the well in such methods therefore require separate trips of tubular members into the well.

SUMMARY OF THE DISCLOSURE

Embodiments of this disclosure include systems and methods for drilling to a final target depth and completing a well with a liner in a single trip into the well. Reducing the number of trips into the well can reduce the risk of a stuck pipe. The drill string used to drill to the final target depth can include a bottom hole assembly that has a smart completion. The components of the smart completion can withstand the torque, compression, and tension associated with drilling operations using a rotating drill string. The components of the smart completion can further be designed to meet burst, collapse, and stiffness requirements of a rotating drill string used for drilling operations.

In an embodiment of this disclosure, a method for completing a subterranean well with a smart completion system includes drilling the subterranean well to a first depth with a first drill string. The first drill string includes a first drill string tubular and a first bottom hole assembly with a first drill bit. The first drill string is retrieved. A casing is cemented in place within the subterranean well within a zone of the first depth of the subterranean well. The subterranean well is drilled to a second depth with a second drill string. The second drill string has a second drill string tubular, a liner, and a second bottom hole assembly that includes a smart completion and a second drill bit. The liner is secured within the casing and the second drill string tubular is retrieved, retaining the liner and the second bottom hole assembly within the subterranean well. Fluid from the subterranean well is produced through the second bottom hole assembly.

In alternate embodiments, drilling the subterranean well can further include rotating the second drill string tubular, the liner, and the second bottom hole assembly, including rotating the smart completion and the second drill bit. The second drill string can further include a differential valve tool. The method can further include cementing an annular space between the liner and an interior surface of the subterranean well with the differential valve tool. A liner hanger can be set in the casing. Setting the liner within the casing can include suspending the liner from the liner hanger. A whipstock can be installed within the first depth. Drilling the subterranean well to the second depth can include drilling a deviated wellbore guided by the whipstock. The smart completion can have a constant outer diameter.

In an alternate embodiment of this disclosure, a smart completion system for completing a subterranean well includes a first drill string. The first drill string has a first drill string tubular and a first bottom hole assembly with a first drill bit. The first drill string is operable to drill the subterranean well to a first depth. A casing is cemented in place within the subterranean well within a zone of the first depth of the subterranean well. A second drill string has a second drill string tubular, a liner, and a second bottom hole assembly that includes a smart completion and a second drill bit. The second drill string is operable to drill the subterranean well to a second depth. The liner is settable within the casing, and the second drill string tubular is retrievable from the subterranean well while retaining the liner and the second bottom hole assembly within the subterranean well. The second bottom hole assembly is operable for producing fluid from the subterranean well through the second bottom hole assembly.

In alternate embodiments, the second drill string tubular, the liner, and the second bottom hole assembly can be rotatable for drilling the subterranean well. The second drill string can further include a differential valve tool operable for cementing an annular space between the liner and an interior surface of the subterranean well. A liner hanger can be set within the casing, the liner hanger operable for engaging the liner and suspending the liner from the casing. A whipstock can be located within the first depth and operable to guide the second drill string for drilling a deviated wellbore to the second depth. The smart completion can have a constant outer diameter.

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
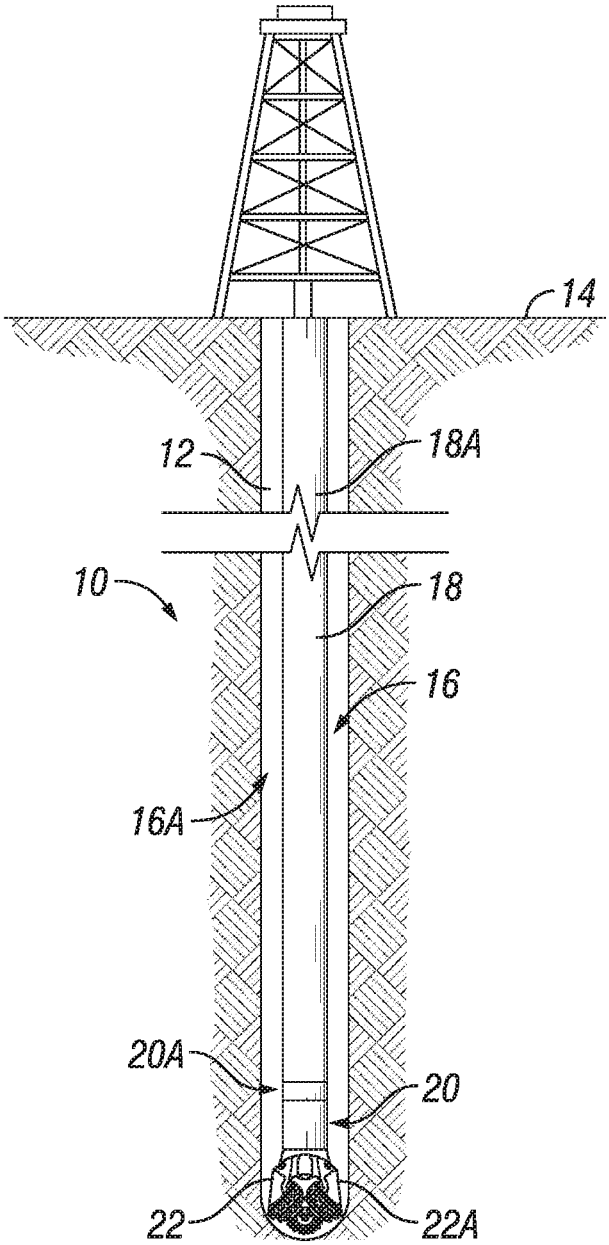
FIG. 1 is a schematic section view of a subterranean well being drilled with a drill string, in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Wellbore 12 can be drilled from surface 14 and into and through various subterranean formations.

Drill string 16 can be delivered into and located within wellbore 12. Drill string 16 can include drill string tubular 18 and bottom hole assembly 20. Drill string tubular 18 can extend from surface 14 into subterranean well 10. Bottom hole assembly 20 can include, for example, drill collars, stabilizers, reamers, shocks, a bit sub and drill bit 22. Drill string 16 can be used to drill wellbore 12. Drill string tubular 18 can be rotated to rotate drill bit 22 to drill wellbore 12.

In the example embodiment of FIG. 1, drill string 16 is a first drill string 16A having first drill string tubular 18A and first bottom hole assembly 20A with first drill bit 22A. First drill string 16A can be used to drill subterranean well 10 to a first depth. The first depth can be, for example, the depth at which wellbore 12 reaches or enters a subterranean reservoir of interest, or a depth at which a deviated well, such as a horizontal well or other directionally drilled well is planned to intersect the pilot section of wellbore 12.

Figure 2:
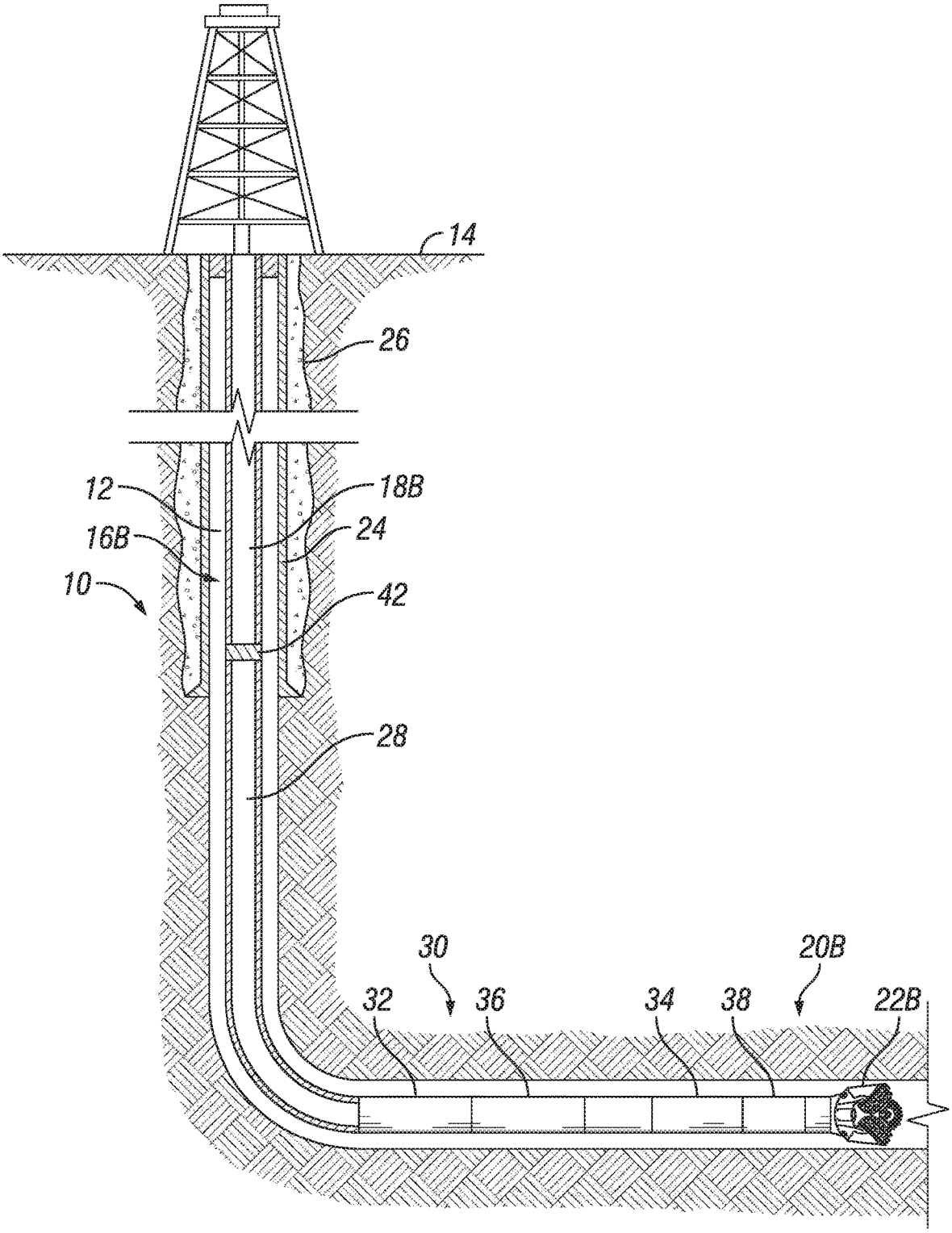
FIG. 2 is a schematic section view of a subterranean well with a smart completion system, in accordance with an embodiment of this disclosure, shown with the smart completion connected to a drill string tubular.

After reaching the first depth, first drill string 16A can be retrieved. Looking at FIG. 2, casing 24 can be cemented in place within a zone of the first depth of subterranean well 10 with cement 26. In an example embodiment, casing 24 can extend within subterranean well 10 a distance of 4000 to 6000 feet. In alternate embodiments, casing 24 can extend within subterranean well 10 less than 4000 feet or more than 6000 feet. There may be only one cemented casing 24, as shown in the example embodiment of FIG. 2. In alternate embodiments, first drill string 16A can be used again to drill wellbore 12 to a greater depth and additional casing members that extend from the surface can be cemented within subterranean well 10.

Second drill string 16B can be used to continue the drilling of subterranean well 10. Second drill string 16B can drill subterranean well 10 to a second depth. The second depth can be the final depth of wellbore 12 so that after second drill string 16B reaches the second depth, subterranean well 10 is ready to be completed and made operational. Drilling subterranean well 10 to the second depth further can be accomplished by rotating second drill string 16B.

Second drill string 16B includes second drill string tubular 18B, liner 28, and second bottom hole assembly 20B that includes smart completion 30 and second drill bit 22B. When drilling subterranean well, second drill string tubular 18B, liner 28, and second bottom hole assembly 20B, including smart completion 30 and second drill bit 22B can all be rotated. Having the full second drill string 16B in rotational motion can assist in drilling a uniformly developed wellbore 12, even into and through the producing zone of subterranean well 10.

In addition, smart completion 30 can be formed of components that result in smart completion 30 having a generally uniform or constant outer diameter. In example embodiments, smart completion 30 can have a uniform outer diameter of 4-½ inches where a 4-½ inch completion is to be used. In alternate example embodiments, smart completion 30 can have a uniform outer diameter of 5-½ inches where a 5-½ inch completion is to be used. In other alternate embodiments, smart completion 30 can have a uniform outer diameter that is consistent with the outer diameter of another size of completion to be used. In order for smart completion 30 to have a uniform outer diameter, any equipment or tools that are part of smart completion 30 can have an outer surface that is flush with the outer diameter of smart completion 30, or can be retained radially within smart completion 30. Having a uniform outer diameter can also assist in drilling a uniformly developed wellbore 12, which means the hole will not have any ledges or sharp elbows. Drilling a uniform hole can result in an enhanced hole geometry and can reduce the risk of a stuck pipe due to hole irregularities. There may be times when an operator can sense that the drill string could be at risk of becoming stuck and will pull the drill string in a direction out of the wellbore by, for example, 50 to 100 feet to ensure the drill string is not stuck. During such operation, if the hole has ledges and elbows the operator may not be able to return the drill bit to the bottom of the hole. Having a uniformly drilled hole will reduce the risk of not being able to return the drill bit to the bottom of the hole.

During drilling operations, second drill string 16B can undergo significant torque, such as, for example, torque in a range of 5,000 to 14,000 feet-pounds (lbs-ft). Each of the components of second drill string 16B can withstand such magnitude of torque. The magnitude of the torque is this is due to a variety of factors including the length of second drill string 16B. As an example, an uphole portion of second drill string 16B is being rotated by surface equipment and must be able to withstand the torque resulting from transmitting such rotation to a downhole portion of second drill string 16B. Smart completions of some currently available systems are not subject to similar magnitudes of torque because such smart completions are delivered into the wellbore only after all drilling operations have been completed. In such systems the smart completion is moved axially into the wellbore without any or with only minimal rotation, and therefore without being subjected to significant resulting rotational torque forces.

During drilling operations, second drill string 16B, including smart completion 30, will also be subject to significant compressive and tensile forces, such as, for example, compressive forces in a range of 4000 to 20,000 pound per square foot (psi) and tensile forces in a range of 400,000 to 900,000 pounds force (lbf). As an example, a weight can be applied to second drill string 16B in order to apply weight to second drill bit 22B to progress the drilling of wellbore 12. Such weight will be transferred through smart completion 30.

As an alternate example, a wiper trip may be undergone during drilling operations where second drill string 16B is pulled in an uphole direction for a distance then returned in a downhole direction in order to ensure that wellbore 12 is adequately sized and accessible. Second drill string 16B can be pulled in an uphole direction, as an example, a distance of up to thousands of feet. The movement of second drill string 16B can be accomplished using an overpull, in particular if second drill string 16B gets hung up at a certain depth, which can apply a tensile force on second drill string 16B, including applying a tensile force on smart completion 30. Smart completions of some currently available systems are not subject to similar magnitudes of compressive or tensile forces because such smart completions are delivered into the wellbore only after all drilling operations have been completed. In such systems the smart completion is moved axially into the wellbore and directly to the final landing position.

During drilling operations, second drill string 16B, including smart completion 30, can further be subject to a pressure differential between an internal bore and an annular space outside of second drill string 16B within wellbore 12. As an example, during drilling operations, drilling mud can be circulated between the interior of second drill string 16B and the annular space outside of second drill string 16B within wellbore 12. If nozzles through second drill bit 22B become plugged, a back pressure within second drill string 16B can be created, increasing the pressure within second drill string 16B relative to the pressure of the annular space outside of second drill string 16B within wellbore 12. Such pressure differential can subject second drill string 16B to a risk of bursting at any weak points. Second drill string 16B, including smart completion 30, can be designed to withstand such burst forces, which may be in a range, for example, of 8,000 to 16,000 psi.

As an alternate example, if the weight of drilling mud within the annular space outside of second drill string 16B within wellbore 12 is high relative to the weight of fluids within second drill string 16B, then a differential pressure can exist with the pressure within the annular space outside of second drill string 16B within wellbore 12 being high relative to the pressure within second drill string 16B. Such differential pressure can subject second drill string 16B to a risk of collapse at any weak points. Second drill string 16B, including smart completion 30, can be designed to withstand such collapse forces, which may be in a range, for example, of 4,000 to 16,350 psi.

Smart completion 30 can include, for example, packer assembly 32. Packer assembly 32 can be manufactured with an increased percentage of high grade rubber compared to currently available packers such that packer assembly 32 can withstand the torque forces, the compression and tension, the burst and collapse forces, and any other forces that are applied to smart completion 30 as smart completion 30 is used for the drilling of wellbore 12. Packer assembly 32 can be in a retracted position of FIG. 2, when second drill string 16B is delivered into wellbore 12. In the retracted position, packer assembly 32 has an outer diameter that is generally constant with the adjacent components of smart completion 30. In the expanded position of FIG. 3, packer assembly 32 engages an inner diameter surface of wellbore 12 and seals the annular space outside of second drill string 16B within wellbore 12.

In order to protect packer assembly 32 during drilling operations, packer assembly 32 can be covered by a retractable sleeve that can be shifted open. The retractable sleeve can be shifted open with coiled tubing, a wireline, or other known actuation device. Having packer assembly 32 covered with a metal sleeve will protect packer assembly 32 from contact with the formation while drilling and rotating. The metal sleeve can include a nipple so that it is possible to shift the metal sleeve open when it is desired to expose packer assembly 32 and set packer assembly 32. The nipple can be a profile that can include a plug set inside of the nipple. An increase in pressure can shift the sleeve open, then a continued increase in pressure can set the rubber element of packer assembly 32.

Smart completion 30 can further include screen assembly 34. Screen assembly 34 include micro-holes to allow for the production of hydrocarbons through screen assembly 34. In order for screen assembly 34 to withstand the torque forces, the compression and tension, the burst and collapse forces, and any other forces that are applied to screen assembly 34 as screen assembly 34 is used for the drilling of wellbore 12, the radial thickness and material of screen assembly 34 is increased compared to currently available screens. Screen assembly 34 can be part of the production fluid flow path that allows production fluids that are located in the annular space outside of second drill string 16B within wellbore 12 to enter liner 28 through smart completion 30. Screen assembly 34 can be covered by a retractable sleeve that can be shifted open. The retractable sleeve can be shifted open with coiled tubing, a wireline, or other known actuation device. The retractable sleeve can be shifted open to allow for the wellbore fluids to enter liner 28 and be produced to the surface.

Smart completion 30 can also include sensor assembly 36 and monitoring assembly 38. Sensor assembly 36 can detect, record, and transmit information collected within wellbore 12. As an example, sensor assembly 36 can measure and transmit the temperature, pressure, or both temperature and pressure within wellbore 12 and transmit such information to an operator at the earth's surface.

Figure 3:
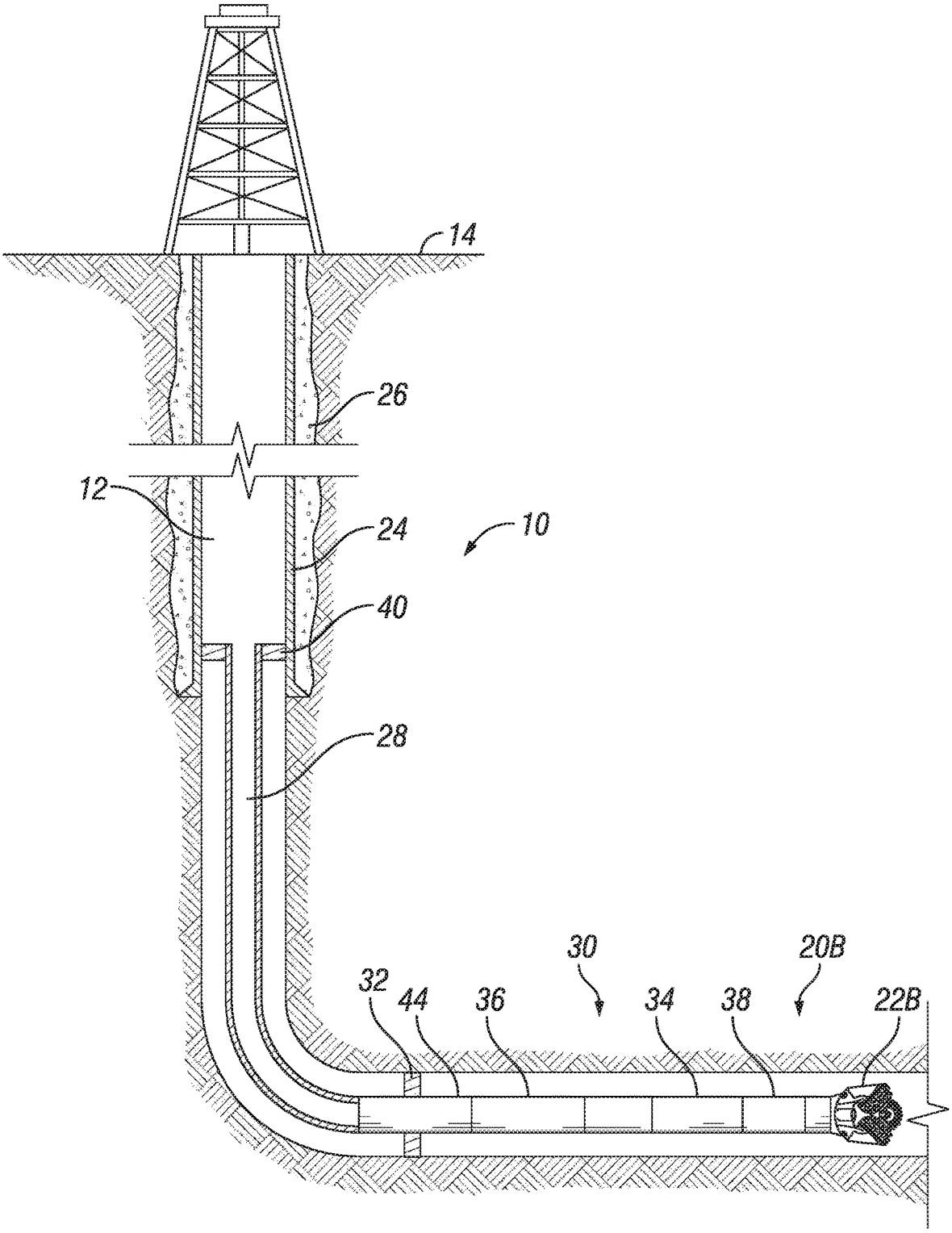
FIG. 3 is a schematic section view of a subterranean well with a smart completion system, in accordance with an embodiment of this disclosure, shown with the liner engaging a liner hanger and the smart completion in a well operational configuration.

Looking at FIG. 3, after second drill string 16B reaches a final target depth, liner hanger 40 can be set in casing 24. Liner 28 can then be suspended within casing 24 with liner hanger 40. Second drill string tubular 18B can then be detached from liner 28 at liner sub 42 (FIG. 2) and second drill string tubular 18B can be retrieved. Liner 28 and second bottom hole assembly 20B are retained within wellbore 12 of subterranean well 10. Liner sub 42 can withstand the torque forces, the compression and tension forces, and the burst and collapse forces applied to second drill string 16B during drilling operations. Liner sub 42 can be manufactured of a grade of pipe that provides liner sub 42 with the ability to withstand to withstand the torque forces, the compression and tension, the burst and collapse forces, and any other forces that are applied to liner sub 42 as liner sub 42 is used for the drilling of wellbore 12

In certain embodiments, second drill string 16B further includes a differential valve tool 44. Differential valve tool 44, can be used for cementing an annular space between liner 28 and an interior surface of subterranean well 10. As an example, all or a portion of the annular space between liner 28 and an interior surface of subterranean well 10 that is downhole of casing 24 and uphole of packer assembly 32 can be filled with cement by way of differential valve tool 44. In alternate embodiments, any or all non-producing zones in contact with the annular space between liner 28 and an interior surface of subterranean well 10 can be cemented.

Second drill bit 22B can be abandoned within wellbore 12 and remain within subterranean well 10 over the operating life of subterranean well 10. Abandoning second drill bit 22B can protect the integrity of the inner diameter of second bottom hole assembly 20B because second bottom hole assembly 20B will not be scratched or otherwise damaged by attempting to retrieve second drill bit 22B through second bottom hole assembly 20B.

Figure 4:
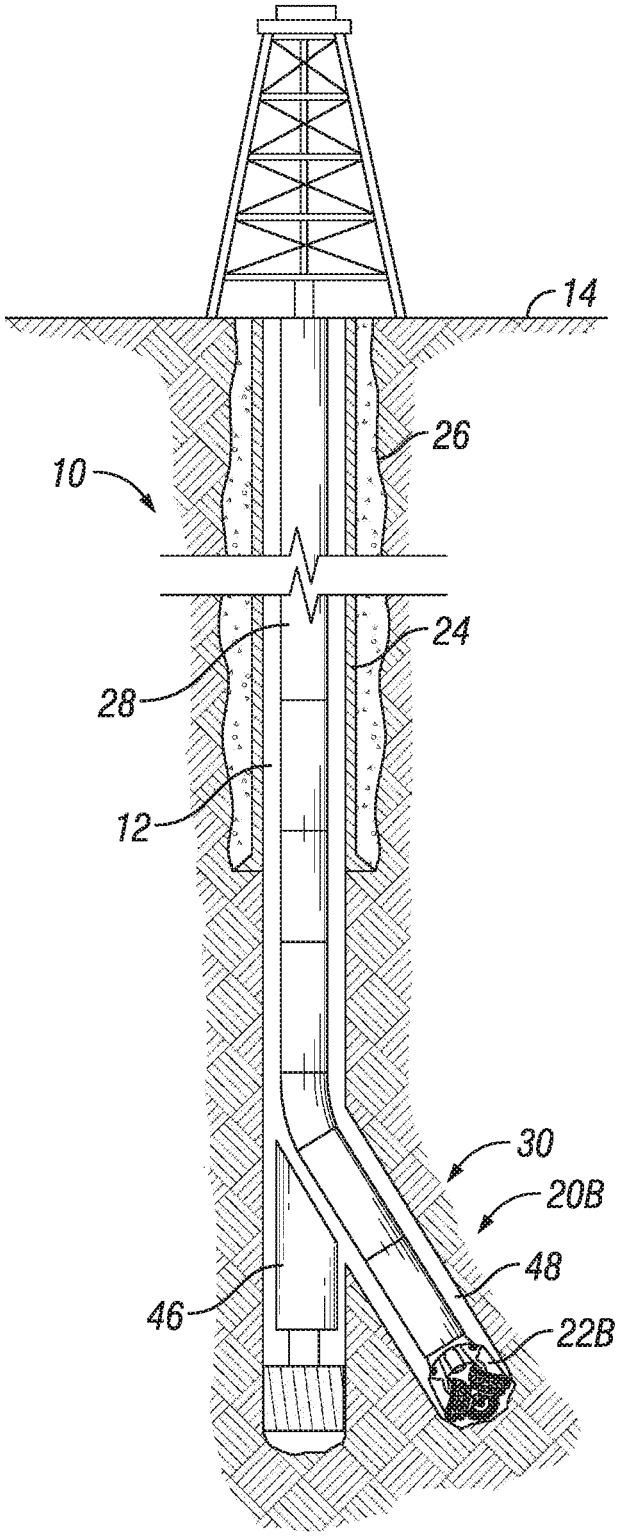
FIG. 4 is a schematic section view of a subterranean well with a smart completion system, in accordance with an embodiment of this disclosure, shown with the drill string engaging a whipstock.

Looking at FIG. 4, in an alternate embodiment, after reaching the first depth, first drill string 16A can be retrieved and whipstock 46 can be installed within a zone of the first depth of subterranean well 10. Second drill string 16B can then be used to drill subterranean well 10 to the second depth by drilling deviated wellbore 48 as second drill string 16B is guided by whipstock 46.

In an example of operation, looking at FIG. 1, a method for completing subterranean well 10 with a smart completion system includes drilling the subterranean well 10 to a first depth with first drill string 16A having first drill string tubular 18A and first bottom hole assembly 20A with first drill bit 22A. First drill string; 16A is then retrieved from subterranean well 10 and looking at FIG. 2, casing 24 is cemented into place within a zone of the first depth of subterranean well 10.

Second drill string 16B can then be used to drill subterranean well 10 to a second depth. The second drill string 16B includes liner 28 and second bottom hole assembly 20B that includes smart completion 30. Liner 28 can be set within casing 24 and second drill string tubular 18B can be retrieved to the surface. Liner 28 and second bottom hole assembly 20B are retained within wellbore 12. Fluids from subterranean well 10 can be produced through second bottom hole assembly 20B.

Therefore embodiments of this disclosure provide systems and methods for completing a subterranean well by drilling to a final target depth with a drill string that includes a liner and a smart completion. Embodiments of this disclosure reduce the number of required trips into the well compared to some current methods of completing a subterranean well. Embodiments of this disclosure reduce the risk of having a stuck pipe while pulling a string out of the hole or running into the hole. With proper planning between drilling engineering and reservoir management, the number and spacing of compartments can be decided based on the desired reservoir contact length and production rate. As used in this specification, a compartment can include a sand screen with a packer located at each end of the sand screen. Each compartment can be used to isolate production from a particular production zone.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A method for completing a subterranean well with a smart completion system, the method including:

drilling the subterranean well to a first depth with a first drill string having a first drill string tubular and a first bottom hole assembly with a first drill bit;

retrieving the first drill string;

cementing a casing in place within the subterranean well within a zone of the first depth of the subterranean well;

drilling the subterranean well to a second depth with a second drill string having a second drill string tubular, a liner, and a second bottom hole assembly that includes a smart completion and a second drill bit, where drilling the subterranean well to the second depth includes rotating the second drill string tubular, the liner, and the second bottom hole assembly, including rotating the smart completion and the second drill bit;

setting the liner within the casing and retrieving the second drill string tubular, retaining the liner and the second bottom hole assembly within the subterranean well; and producing fluid from the subterranean well through the second bottom hole assembly.

2. The method of claim 1, where the second drill string further includes a differential valve tool, the method further including cementing an annular space between the liner and an interior surface of the subterranean well with the differential valve tool.

3. The method of claim 1, further including setting a liner hanger in the casing, and where setting the liner within the casing includes suspending the liner from the liner hanger.

4. The method of claim 1, further including installing a whipstock within the first depth, and where drilling the subterranean well to the second depth includes drilling a deviated wellbore guided by the whipstock.

5. The method of claim 1, where the smart completion has a constant outer diameter.

6. A smart completion system for completing a subterranean well, the system including:

a first drill string having a first drill string tubular and a first bottom hole assembly with a first drill bit, the first drill string operable to drill the subterranean well to a first depth;

a casing cemented in place within the subterranean well within a zone of the first depth of the subterranean well;

a second drill string having a second drill string tubular, a liner, and a second bottom hole assembly that includes a smart completion and a second drill bit, the second drill string operable to drill the subterranean well to a second depth; where the liner is settable within the casing, and the second drill string tubular is retrievable from the subterranean well while retaining the liner and the second bottom hole assembly within the subterranean well;

the second bottom hole assembly is operable for producing fluid from the subterranean well through the second bottom hole assembly; and the second drill string tubular, the liner, and the second bottom hole assembly are rotatable for drilling the subterranean well.

7. The system of claim 6, where the second drill string further includes a differential valve tool operable for cementing an annular space between the liner and an interior surface of the subterranean well.

8. The system of claim 6, further including a liner hanger set within the casing, the liner hanger operable for engaging the liner and suspending the liner from the casing.

9. The system of claim 6, further including a whipstock located within the first depth and operable to guide the second drill string for drilling a deviated wellbore to the second depth.

10. The system of claim 6, where the smart completion has a constant outer diameter.

* * * * *